US009061692B1

(12) United States Patent
Dibble et al.

(10) Patent No.: US 9,061,692 B1
(45) Date of Patent: Jun. 23, 2015

(54) SYSTEM AND METHOD FOR TRAIN POSITION SENSING

(71) Applicants: Merton F. Dibble, Morganton, GA (US); Joseph Capers, Lakeland, FL (US)

(72) Inventors: Merton F. Dibble, Morganton, GA (US); Joseph Capers, Lakeland, FL (US)

(73) Assignee: RAIL-VEYOR SYSTEMS, INC., Morganton, GA (US)

( * ) Notice: Subject to any disclaimer, the term of this patent is extended or adjusted under 35 U.S.C. 154(b) by 213 days.

(21) Appl. No.: 13/858,878

(22) Filed: Apr. 8, 2013

Related U.S. Application Data

(63) Continuation-in-part of application No. 13/570,982, filed on Aug. 9, 2012, now abandoned.

(60) Provisional application No. 61/521,520, filed on Aug. 9, 2011.

(51) Int. Cl.
*B61L 25/02* (2006.01)

(52) U.S. Cl.
CPC ..... *B61L 25/02* (2013.01)

(58) Field of Classification Search
CPC . B61L 25/025; B61L 27/0077; B61L 25/045; B61L 25/048; B61L 25/00; B61I 25/02; B61I 25/028; B61I 25/04
USPC ..... 701/19; 246/122 R
See application file for complete search history.

(56) References Cited

U.S. PATENT DOCUMENTS

| | | | | |
|---|---|---|---|---|
| 8,140,250 | B2 * | 3/2012 | Mian et al. | 701/117 |
| 8,380,361 | B2 * | 2/2013 | Evans | 701/2 |
| 2007/0276555 | A1 * | 11/2007 | Kiss et al. | 701/19 |
| 2008/0068164 | A1 * | 3/2008 | Campbell | 340/572.1 |
| 2008/0269957 | A1 * | 10/2008 | Rooney et al. | 701/1 |
| 2011/0238241 | A1 * | 9/2011 | Brady et al. | 701/19 |
| 2012/0153089 | A1 * | 6/2012 | Galm et al. | 246/122 R |
| 2012/0303187 | A1 * | 11/2012 | Sexauer et al. | 701/19 |

* cited by examiner

*Primary Examiner* — Mark Le
(74) *Attorney, Agent, or Firm* — Allen Dyer Doppelt Milbrath & Gilchrist

(57) ABSTRACT

Train position is sensed using a position sensing unit having plurality of position sensors arrayed in the direction of train travel. The sensors respond to the presence and absence of a detection element on each train car, the detection element being longer than the spacing between adjacent position sensors. A confirmed count of a train car passing the position sensing unit requires detection of a series of related position sensor activations and deactivations. Alternately, the position sensing unit senses data tags on the train cars, reading unique identifiers therefrom. A list of identifiers corresponding to the car order is stored and compared to the identifiers read in order to determine train position.

9 Claims, 4 Drawing Sheets

SYSTEM AND METHOD FOR TRAIN POSITION SENSING

CROSS-REFERENCE TO RELATED APPLICATIONS

This application is a continuation-in-part of U.S. Nonprovisional patent application Ser. No. 13/570,982, filed on Aug. 9, 2012, which claims the benefit of U.S. Provisional Patent Application Ser. No. 61/521,520, filed on Aug. 9, 2011, the contents of which applications are herein incorporated by reference in their entirety.

FIELD OF INVENTION

The present invention generally relates to determining train position, and more particularly, to determining train position in automated train systems with no internal drive.

BACKGROUND OF THE INVENTION

It is known to sense a train's position by using an arrangement of proximity sensors located so as to sense both a train's side plate and each wheel of the train as it approaches and passes a drive station, as disclosed in U.S. Pat. No. 8,140,202 for "Method of Controlling a Rail Transport System for Conveying Bulk Materials" the disclosure of which is herein incorporated by reference in its entirety. Although the train position determination systems and methods employed therein have been found effective, further improvements are possible.

SUMMARY OF THE INVENTION

In view of the foregoing, it is an object of the present invention to provide improved systems and methods for sensing train position. According to an embodiment of the present invention, a train system comprises a track extending in a travel direction, a plurality of cars riding on the track and connected to form a train, a position sensing unit, and a programmable logic controller (PLC) in signal communication with the position sensing unit and configured to determine a train position based on inputs therefrom.

In one position sensing unit embodiment, each of the plurality of cars has a substantially identical car length in the travel direction and there are a plurality of car detection elements on the plurality of cars. Each of the plurality of car detection elements has a substantially identical detection element length in the travel direction, the detection element length being less than the car length.

The position sensing unit includes a first position sensor arranged along the track responsive to the presence and absence of each of the plurality of car detection elements and a second position sensor arranged along the track responsive to the presence and absence of each of the plurality of car detection elements and separated from the first position sensor in the travel direction by a first sensor spacing, the first sensor spacing being less than the detection element length.

According to an alternate position sensing unit embodiment, the cars are connected in a car order and a plurality of data tags are arranged on the plurality of cars, each of the plurality of data tags storing a unique identifier. The position sensing unit includes a data tag reader arranged along the track and operable to detect each of the plurality of data tags in sequence and read the unique identifiers therefrom. The programmable logic controller stores a list of the unique identifiers corresponding to the car order and is configured to determine a train position based on inputs from the position sensing unit and the stored list.

These and other objects, aspects and advantages of the present invention will be better appreciated in view of the drawings and following detailed description of preferred embodiments.

DETAILED DESCRIPTION OF PREFERRED EMBODIMENTS

Figure 1:
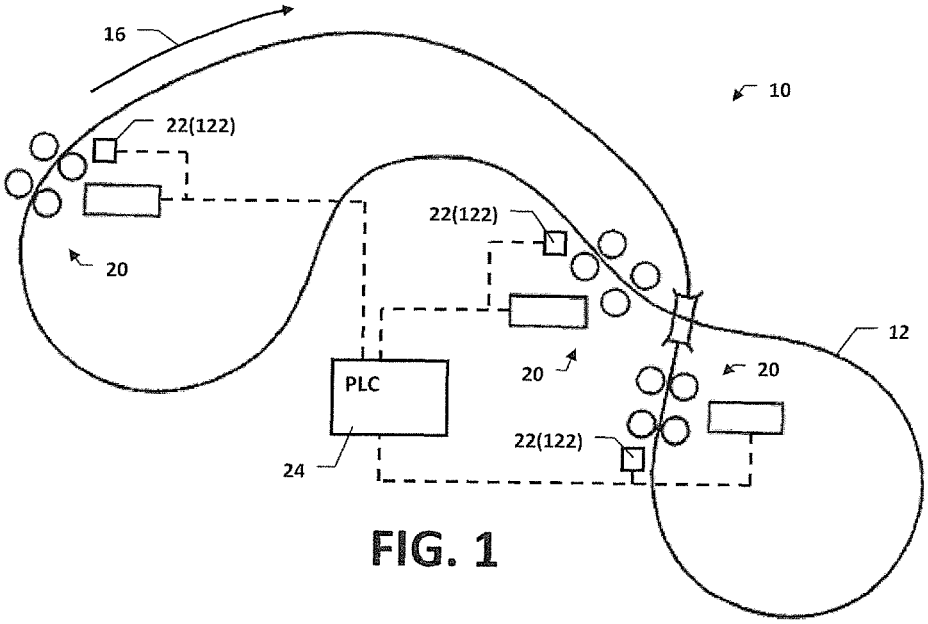
FIG. 1 is a schematic overview of a train system with position sensing units, according to an embodiment of present invention.
Figure 2:
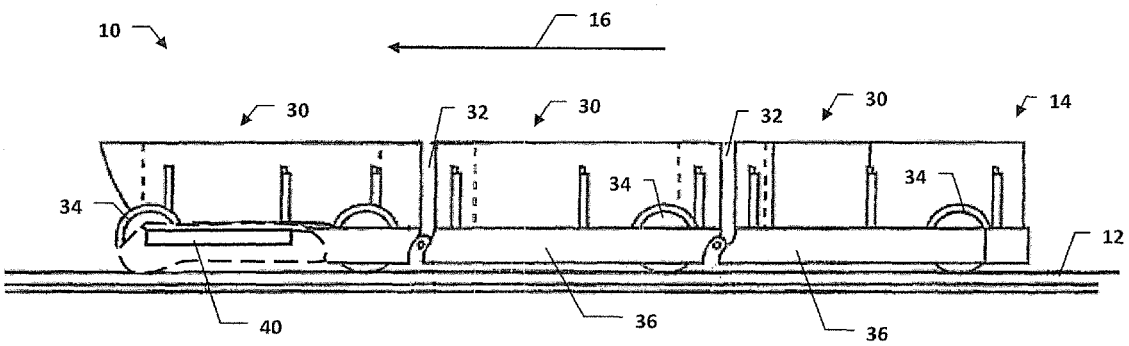
FIG. 2 is a side view of a portion of the train system of FIG. 1, with a train thereon shown in partial cutaway to reveal hidden components.

Referring to FIGS. 1 and 2, according to an embodiment of the present invention a train system 10 includes a track 12 having one or more trains 14 riding thereon. The track 12 extends in a travel direction 16 and the trains 14 are driven in (forward) and counter to (reverse) the travel direction 16 by a plurality of drive stations 20. A plurality of position sensing units 22 each determines positions of the trains 14. A programmable logic controller (PLC) 24 is in signal communication with the drive stations 20 and position sensing units 22, and is configured to drive the train 14 with drive stations 20 based on the train positions determined by the position sensing units 22.

Figure 3:
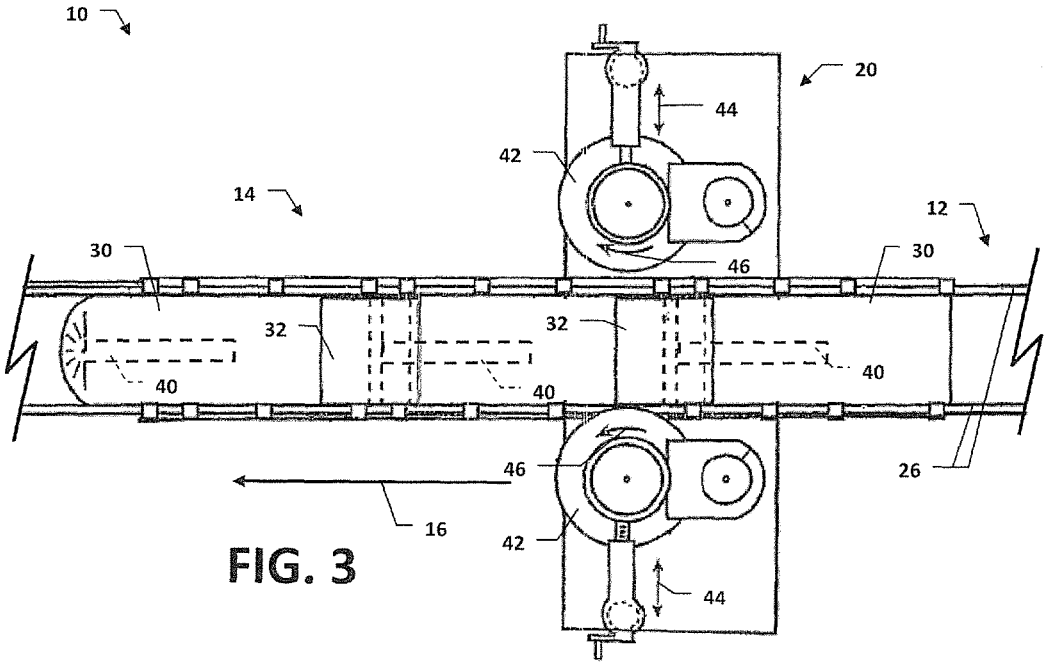
FIG. 3 is a top view of a portion of the train system of FIG. 1, including a drive station with the train of FIG. 2 passing therethrough, with hidden components shown in broken lines.

Referring also to FIG. 3, the track 12 preferably includes a pair of generally parallel rails 26, although other track 12 configurations could be employed. The track 12 can be arranged in a continuous loop or have discrete start and end points. Additionally, the track can have distinct branches, elevated sections, inverted sections, tunnels, etc. Essentially, the present invention can be employed with virtually any track configuration.

Referring to FIGS. 2 and 3, the train 14 includes a plurality of cars 30 connected sequentially. Advantageously, flaps 32 extend between the cars 30, such that a continuous trough is formed along the length of the train 14, although other train car types could be used in connection with the present invention. A car length of each car in the travel direction 16 is preferably approximately equal. Additionally, the cars 30 can preferably roll in both right-side up and inverted positions on wheels 34. The cars 30 depicted include side plates 36 that are engaged by the drive stations 20 in order to impel the cars 30 in and against the travel direction 16, as will be explained in greater detail below. Although only three cars 30 are depicted for economy of illustration, trains composed of more or fewer cars could also be employed.

Each car 30 carries a car detection element 40, to the presence and absence of which the position sensing units 22 are responsive. The car detection element 40 can be an integral part of the car, or mounted onto the car. In the depicted embodiment, the car detection element 40 is a metal member elongated in the travel direction 16 and attached to the bottom of each car 30. Preferably the length of the car detection element 40 in the travel direction is less than the car length. For example, the car detection element 40 can be an approximately 1 inch×2 inch×4 foot metal tube mounted to the bottom of an approximately 8 foot long car.

Referring to FIG. 3, in the depicted embodiment, each drive station 20 includes a pair of drive wheels 42 mounted on opposite sides of the track 12. More or fewer drive wheels/pairs could be employed based on operational requirements, or another driving mechanism could be employed. The drive wheels 42 are laterally positioned in direction 44 so as to engage the side plates 36 on the on the cars 30. With the drive wheels 42 powered to spin in direction 44, the train 14 is thereby impelled forward in the travel direction 16. The train 14 can be impelled in reverse against the travel direction by turning the drive wheels 42 opposite direction 46. The drive wheels 42 can also be used to decelerate the train 14. The drive wheels 42 are preferably powered by one or more variable frequency (VFD) drives, as directed by the PLC 24.

Figure 4:
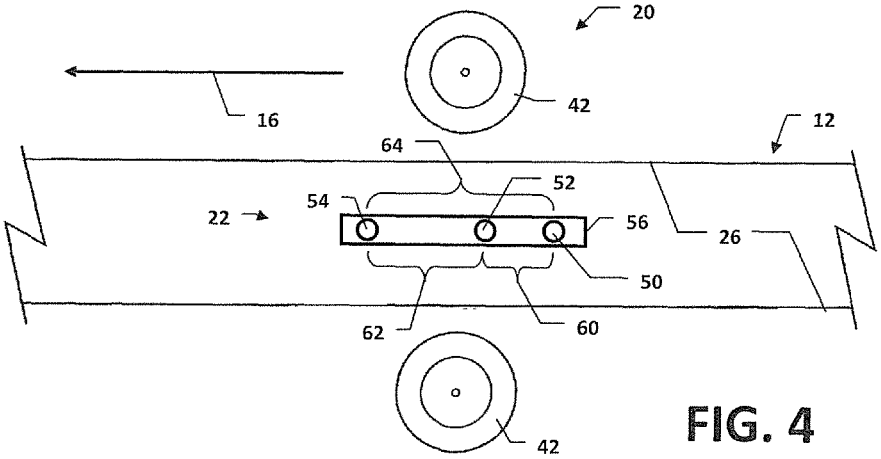
FIG. 4 is a top view of the drive station of FIG. 3, with components removed and the train absent, showing an exemplary position sensing unit of FIG. 1.

Referring to FIG. 4, an exemplary one of the position sensing units 22 includes a plurality of position sensors 50, 52, 54 arranged one after the other in the travel direction 16. The other units 22 are preferably substantially identical, but only one is illustrated for the sake of brevity. For ease of installation and replacement, the sensors 50, 52, 54 are commonly located on a sensor mount 56. The sensor mount 56 is arranged between the rails 26 of the track 12 such that the train 14 will pass thereover. In this arrangement, the sensors 50, 52, 54 are positioned such that each car detection element 40 passes within their nominal range; for example, the car detection elements 40 will pass approximately 0.750 inches over the position sensors 50, 52, 54.

In the depicted embodiment, the sensors 50, 52, 54 are very preferably proximity sensors, such as inductive proximity sensors, that are responsive to the presence and absence of the car detection elements 40 without making physical contact therewith. Preferably, the sensors 50, 52, 54 are highly unresponsive to nonmetallic objects, and to any objects outside of their nominal range. With no moving parts and largely immune to interference from dust and dirt, such sensors can function very reliably with little or no maintenance in many harsh environments.

There are most preferably at least two position sensors, and the depicted embodiment includes first, second and third sensors 50, 52, 54. The first and second position sensors 50, 52 are separated in the travel direction 16, by a first sensor spacing 60. The third sensor 54 is separated from the second sensor 52 in the travel direction 16 by a second sensor spacing 62. The first and third sensors 50, 54 are separated in the travel direction 16 by a third sensor spacing 64, which is equal to the sum of the first and second sensor spacings 60, 62. Although different numbers and spacings of sensors could be used, the following spacing properties are particularly advantageous:

a. the first and second sensor spacings 60, 62 are each less than the detection element length;
b. the first and second sensor spacings 60, 62 are not equal to each other;
c. the third sensor spacing 64 is greater than the detection element length; and
d. the third sensor spacing 64 is less than the car length; more particularly less than the spacing of detection elements from one car in the train to the next.

With the exemplary detection element length of approximately 4 feet and the car length of approximately 8 feet provided above, advantageous approximate measurements for the first, second and third sensor spacings are 2 feet, 3 feet and 5 feet, respectively.

The PLC 24 is in signal communication with the drive units 20 and the position sensing units 22. Generally speaking, the PLC determines train position from the position sensing units 22 and controls the drive units 20 (for example, through one or more VFDs) based thereon. As used herein "signal communication" refers to communication effective to convey data. Various wired and/or wireless communications devices could be employed to effectuate signal communication between these components.

The determination of "train position," as used herein, refers broadly to the determination of the physical location of the train and/or derivatives thereof, such as train velocity and train acceleration/deceleration. The present invention is primarily focused on improved systems and methods for determining train position—the methods by which the PLC uses the determined train position to control trains can vary considerably within the scope of the present invention. However, the present invention is particularly advantageous when used in support of a control routine like that in U.S. Pat. No. 8,140,202, referenced above, where the PLC synchronizes drive wheel speeds between drive stations as a train passes from one drive station to the next.

A "PLC" should generally be understood to be a computer device equipped to receive sensor inputs and generating control outputs, and programmable with one or more control routines governing the operational relationship between the inputs and outputs. While the PLC is preferably a purpose-built PLC, such as are marketed for that purpose, the present invention is not necessarily limited thereto.

Figure 5A:
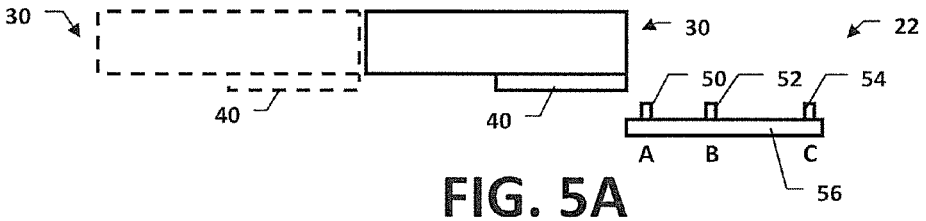
FIGS. 5A to 5G are a series of schematic side views of a train passing over one of the sensing units of FIG. 1.
Figure 5B:
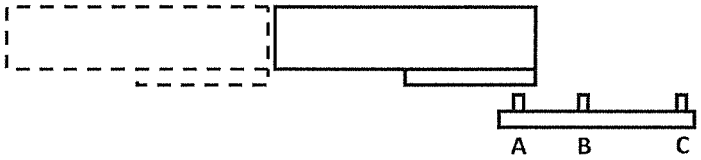
Figure 5C:
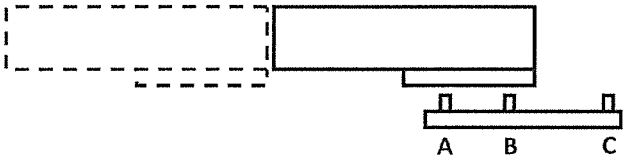
Figure 5D:
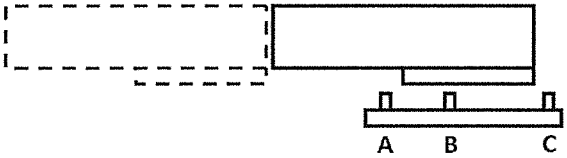
Figure 5E:
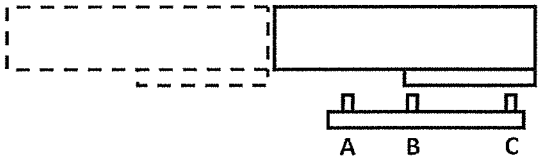
Figure 5F:
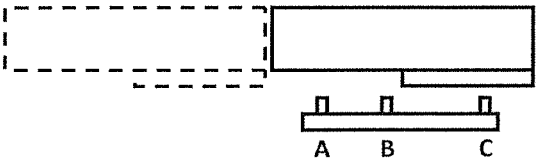
Figure 5G:
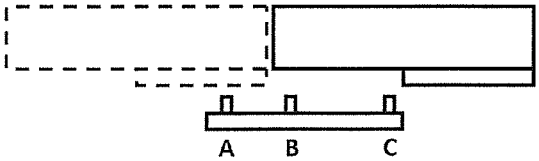
Figure 6:
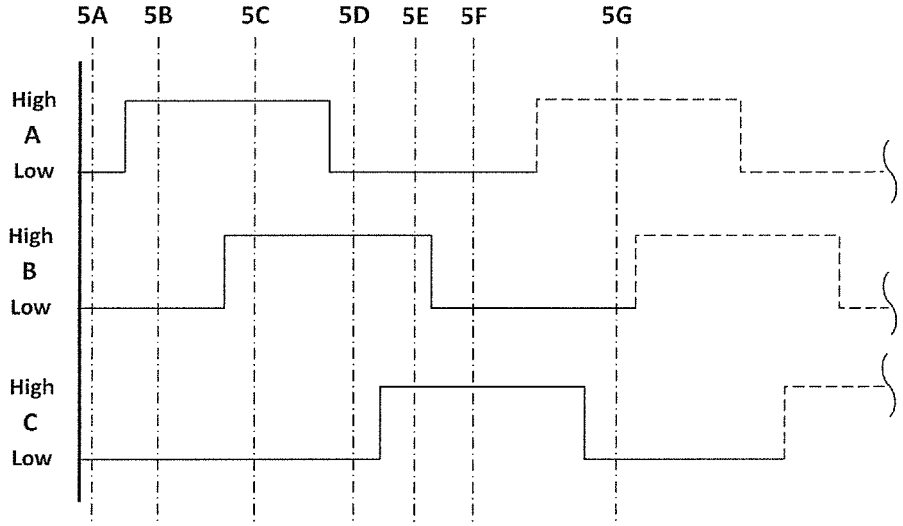
FIG. 6 is a state diagram of states of the position sensing unit of FIG. 5 as the train passes thereover.

Referring to FIGS. 5 and 6, the operation of the position sensing unit 22 in determining train 14 position will be explained in greater detail. FIGS. 5A-5G schematically illustrate positions of a leading (solid lines) and trailing (broken lines) train cars 30 with detection elements 40, as they pass over the first, second and third position sensors 50, 52, 54 (labeled A, B and C).

Each of the position sensors has a high/on output, indicative of the presence of a detection element 40 and a low/off output, indicative of the absence of a detection element 40 (although these states could be reversed while preserving the overall functionality described herein). FIG. 6 illustrates sensor response over time with the cars of FIG. 5 passing thereover (a constant car velocity is used for this example). Sensor activations for the leading car are shown in solid lines, while switching to broken lines for activations by the trailing car. Labeled vertical lines 5A-5G in FIG. 6 indicate sensor states at the car positions depicted in the corresponding FIGS. 5A-5G.

In FIG. 5A, the leading car is still approaching sensor A, thus all of the sensors A, B and C are low. When the leading car reaches the FIG. 5B position, the detection element is over sensor A, but has not yet reaches sensor B, so only sensor A is high. At the FIG. 5C position, the detection element is over both sensors A and B, so both sensors are high. At FIG. 5D, the detection element has cleared sensor A but remains over sensor B, so sensor A goes low but B remains high—until the position of FIG. 5F, when sensor B also goes low.

Without discussing sensor C for the moment, it will be appreciated that use of two sensors (A and B), spaced apart by less than the length of a detection element, offer a very reliable indicator that a car has passed over the sensors—without the need for extra debounce logic to rule out the possibility of intermittent false sensor responses. Before the PLC will count a car as having passed it will need to see the following events, in the following order (for the forward direction—the order would be reversed for a car passing in the opposite direction):

e. Sensor A transition to high while Sensor B is low;

f. Sensor B transition to high while Sensor A is high;

g. Sensor A transition to low while Sensor B is high; and h. Sensor B transition to low while Sensor A is low.

The likelihood of this order of events occurring without a car actually passing over the sensors is extremely remote. Also, the identification of spurious sensor activations for error detection purposes is also relatively straightforward, and an appropriate warning or indication can be made by the PLC.

Including the third sensor (C) further reduces the likelihood of a spurious recognition—a car count would further require:

e. Sensor C transition to high while Sensor B is high (position of FIG. 5E);

f. Sensor B transition to low while Sensor C is high (and A is low, as noted above—position of FIG. 5F); and g. Sensor C transition to low while B is low (position of FIG. 5G).

Besides further minimizing the possibility of a spurious count, the addition of a third sensor is of significant value where a plurality of connected cars are to be sensed. At the position of FIG. 5G, sensor A has transitioned to high for the trailing car, and it will be seen that this transition occurred after sensor B transitioned low but before sensor C did. Thus, the PLC can readily construe this as the beginning of the passage of the second car in the train, since there is sensor continuity (C to A) from the previous car.

While the spacing of two sensors could be adjusted to have sensor B remain high until the next car triggered sensor A, this result would potentially be ambiguous with a reversal of train direction that would re-trigger sensor A. In the depicted embodiment, the reversal possibility would be ruled out because sensor B would need to transition high again (and sensor C transition low) before a reversal could result in re-triggering sensor A. Also, a car count beginning with all sensors low clearly indicates the beginning of a train, while a car count ending with all sensors low clearly indicates the end of a train. The differing first and second sensor spacings 60, 62 further facilitate discrimination between different train-related events.

While the foregoing represents a robust method and system for reliably and accurately determining train position, the present invention is not necessarily limited thereto. For example, the position sensing unit 122 could be used alongside other position sensing components, such as those described in U.S. Pat. No. 8,140,202. Also, other position sensing units 122 could be employed.

Figure 7:
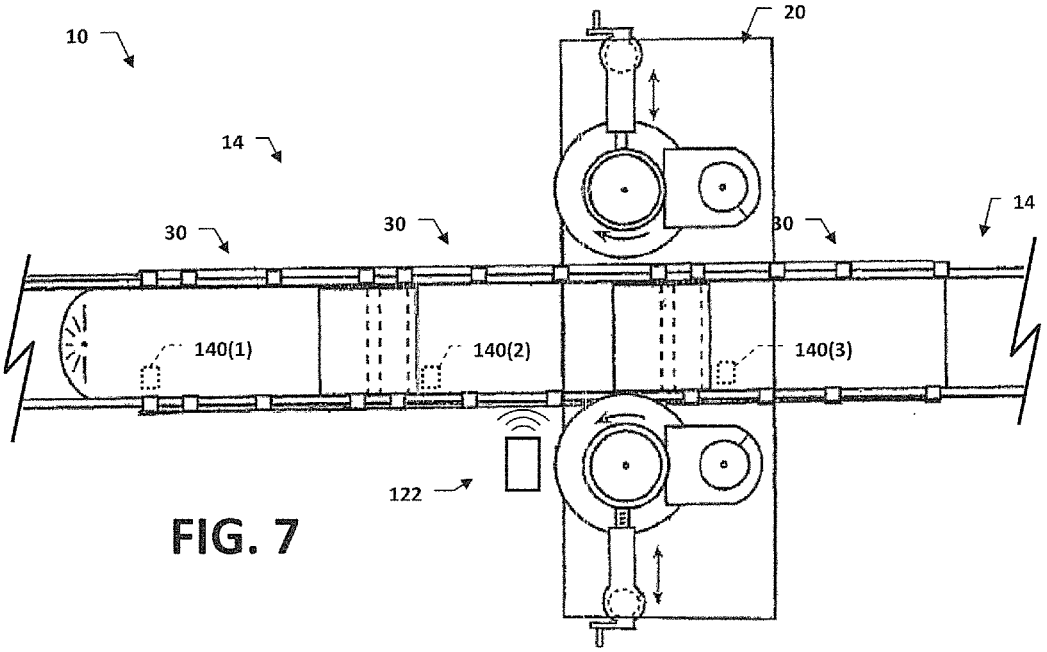
FIG. 7 is a top view of a portion of the train system of FIG. 1, including a drive station with the train of FIG. 2 passing therethrough past an alternate position sensing unit embodiment, with hidden components shown in broken lines.

For example, referring to FIGS. 1 and 7, according to an alternate embodiment of the present invention a positioning sensing unit 122, a data tag reader, is used to detect and read a plurality of data tags 140 on the plurality of cars 30. Each of the data tags 140 stores a unique identifier (such as a car serial number), which is read by the position sensing unit 122. For each train 14 under its control, the PLC 24 stores a list of the unique identifiers corresponding to the order of the cars 30. Preferably, this list is inputted when the corresponding train 14 is placed in service.

By reading the identifiers, the PLC knows the position of every car in the train 14. This train position can be used to control the drive stations 20 substantially as described in connection with the foregoing embodiment. Additionally, if the position sensing unit 122 fails to read an identifier where and when expected—possibly corresponding to a missing or damaged data tag 140, the PLC 24 can be configured to bring the train 14 to a controlled stop until the problem is resolved. Also, the identifiers can identify not only individual cars but classes or types of car. Thus, the PLC 24 can also intervene if identifiers corresponding to improper cars are detected in the system 10.

While this alternate embodiment is not necessarily limited to a particular type of data tag and reader, a most preferred embodiment uses radio frequency identification (RFID) tags for the data tags 140 and a corresponding RFID tag reader in the sensing unit 122. Each of the RFID tags 140 would electronically store the identifier and transmit it to the reader 122 when within range. RFID tags have the advantage of not needing to be located on an outer surface of the cars 30, and are thus more impervious to dislodgment or other damage. Most advantageously, the RFID tags 140 are passive, and are thus powered by the signal received from the sensing unit 122 and transmit their identifier in response. Thus, a separate power source for the tags 140 is not necessary and they can remain in place for an extended period without battery replacement or other maintenance. However, active RFID tags could alternately be employed.

The foregoing examples are provided for illustrative and exemplary purposes; the present invention is not necessarily limited thereto. Rather, those skilled in the art will be appreciate that the variation modifications, as well as adaptations for particular circumstances, will fall within the scope of the invention herein shown and described, and of the claims appended hereto.

What is claimed is:

1. A train system comprising:

a track extending in a travel direction;

a plurality of cars riding on the track and connected in a car order to form a train;

a plurality of data tags on the plurality of cars, each of the plurality of data tags storing a unique identifier;

a position sensing unit including:

a data tag reader arranged along the track and operable to detect each of the plurality of data tags in sequence and read the unique identifiers therefrom; and a programmable logic controller in signal communication with the position sensing unit, the programmable logic controller storing a list of the unique identifiers corresponding to the car order and being configured to determine a train position based on inputs from the position sensing unit and the stored list.

2. The train system of claim 1, wherein the plurality of data tags are radio frequency identification (RFID) tags and the data tag reader is a RFID tag reader.

3. The train system of claim 2, wherein the RFID tags are passive RFID tags.

4. The train system of claim 1, wherein the plurality of data tags are not located on outer surfaces of the plurality of cars.

5. The train system of claim 1, further comprising a drive station arranged along the track and operable by the PLC to impart motion to the train.

6. The train system of claim 5, wherein the PLC is configured to bring the train to a controlled stop if one of the unique identifiers is not read at its place in the car order.

7. The train system of claim 5, wherein the position sensing unit is located at the drive station.

8. The train system of claim 5, further comprising:

a plurality of additional drive stations arranged along the track at intervals and operable by the PLC to impart motion to the train; and a plurality of additional position sensing units identical to the position sensing unit, each of the plurality of additional position sensing units being located a respective one of the plurality of additional drive stations.

9. The train system of claim 8, wherein the PLC is configured sequentially operate the drive stations based on the input from the position sensing units.

* * * * *